United States Patent [19]

Sauder

[11] Patent Number: 4,921,441

[45] Date of Patent: May 1, 1990

[54] SHIELDED BACKSHELL SYSTEM HAVING STRAIN RELIEF AND SHIELD CONTINUITY

[75] Inventor: Jay S. Sauder, Camp Hill, Pa.

[73] Assignee: AMP Incorporated, Harrisburg, Pa.

[21] Appl. No.: 401,365

[22] Filed: Aug. 31, 1989

[51] Int. Cl.[5] ..... H01R 13/58; H01R 13/648

[52] U.S. Cl. ..... 439/460; 439/610

[58] Field of Search ..... 439/460, 469, 472, 610, 439/449

[56] References Cited

U.S. PATENT DOCUMENTS

| | | | |
|---|---|---|---|
| 4,108,527 | 8/1978 | Douty et al. | 339/107 |
| 4,209,661 | 6/1980 | Pate et al. | 439/460 |
| 4,241,970 | 12/1980 | Rider, Jr. et al. | 439/403 |
| 4,367,005 | 1/1983 | Douty et al. | 339/107 |
| 4,561,715 | 12/1985 | Sanchez | 339/103 |
| 4,582,384 | 4/1986 | Frantz et al. | 339/143 |
| 4,689,723 | 8/1987 | Myers et al. | 361/424 |
| 4,721,483 | 1/1988 | Dickie | 439/610 |
| 4,722,580 | 2/1988 | Kocher et al. | 439/466 |
| 4,749,369 | 6/1988 | Wang | 439/460 |

FOREIGN PATENT DOCUMENTS

| | | | |
|---|---|---|---|
| 2183405 | 6/1987 | United Kingdom | 439/460 |

*Primary Examiner*—Gary F. Paumen

*Attorney, Agent, or Firm*—David L. Smith

[57] ABSTRACT

A shielded backshell system (24,26,28,30) provides strain relief to a cable (52) and assures electrical continuity between the cable shield (182) and a shielded backshell member (24 or 26). The shielded backshell assembly (24, 26) includes shielding means (24 or 26) having a cable passage (86) for receiving the shielded cable (52). The shielding means (24 or 26) has an extension (88) extending proximate the cable exit (86). Insert means (32,34) are received in the shielded backshell system proximate the cable exit (86) to engage and compress the cable (52) while simultaneously pressing the shielding member extension (88) into engagement with the shield (182) on the cable (52) to provide electrical continuity therewith.

14 Claims, 4 Drawing Sheets

120
28
130
118
160
154
168
140
122
162
128
122
32
76
74
70
80
24
88
76
78
92
40
90
86
72
84
72
62
22
46
64
182
54
180
58
56
92
96
72
42
62
86
84
52
26
78
70
30
88
82
98
122
126
94
132
128
112
74
118
114
90
76
74
80
148
138
146
128
114
126
136
142
138
134
150
164
166
170
124
163
152
168
165
142
124
122
162
140
136
114
120
122
160
34
20

28
110
138
162'
170'
160'
136
154
168'
164'
32'
166'
122
114
92
24'
88'
190
78
40
94
84
94
22
62
46
44
64
182'
54
180'
56
72
52
62
26
82
190
92
128
122
88'
74
146
148
128
138
136
154
170'
164'
166'
34'
162'
140
122
168'
160'
20

SHIELDED BACKSHELL SYSTEM HAVING STRAIN RELIEF AND SHIELD CONTINUITY

BACKGROUND OF THE INVENTION

This invention relates to shielded electrical connectors and in particular to a strain relief that simultaneously provides strain relief to a shielded cable terminated to an electrical connector and electrical continuity between the cable shielding and shielding surrounding the connector.

There is disclosed in U.S. Pat. No. 4,721,483, a shielded electrical connector. To provide strain relief, the dielectric coating which encloses the braided multiconductor cable and shielding sheath are sliced along the narrow sides of the cable. Soft inserts of rubber like material are placed along the outer non-sliced dielectric coating and shielding sheath. The dielectric coating and shielding sheath are then folded back simultaneously on both sides of the braided cable over a ribbed outer surface of the respective soft insert. When two metal shell halves are positioned over the soft inserts and bolted together, the ribs on the outer surface of the soft inserts are received in grooves in the respective shell half with the sliced dielectric coating and shielding sheath sandwiched therebetween. The shielding sheath provides a ground connection with shell halves for the cable braid. Thus, with the shell halves secured together, the insert applies a force in a direction away from the cable to provide a ground connection for the shielding sheath with shell halves, and a force toward the cable for strain relief. Substantially, the insert is squeezed between the connection and the strain relief.

It would be desirable to have a shielded connector assembly that could accommodate either flat or round shielded cable wherein the strain relief for the cable as well as electrical continuity between the cable shielding and shielding surrounding the connector are achieved by an insert member with the normal force providing the strain relief in the same direction as the normal force assuring electrical continuity.

SUMMARY OF THE INVENTION

In accordance with the present invention, a shielded backshell system provides strain relief to a cable and assures electrical continuity between the cable shield and a shielded backshell member. The shielded backshell assembly includes shielding means having a cable passage for receiving the shielded cable. The shielding means has an extension extending along the cable exit. Insert means are received in the shielded backshell system along the cable exit to engage and compress the cable as well as press the shielding member extension into engagement with the shield on the cable.

DESCRIPTION OF THE PREFERRED EMBODIMENT

Figure 1:
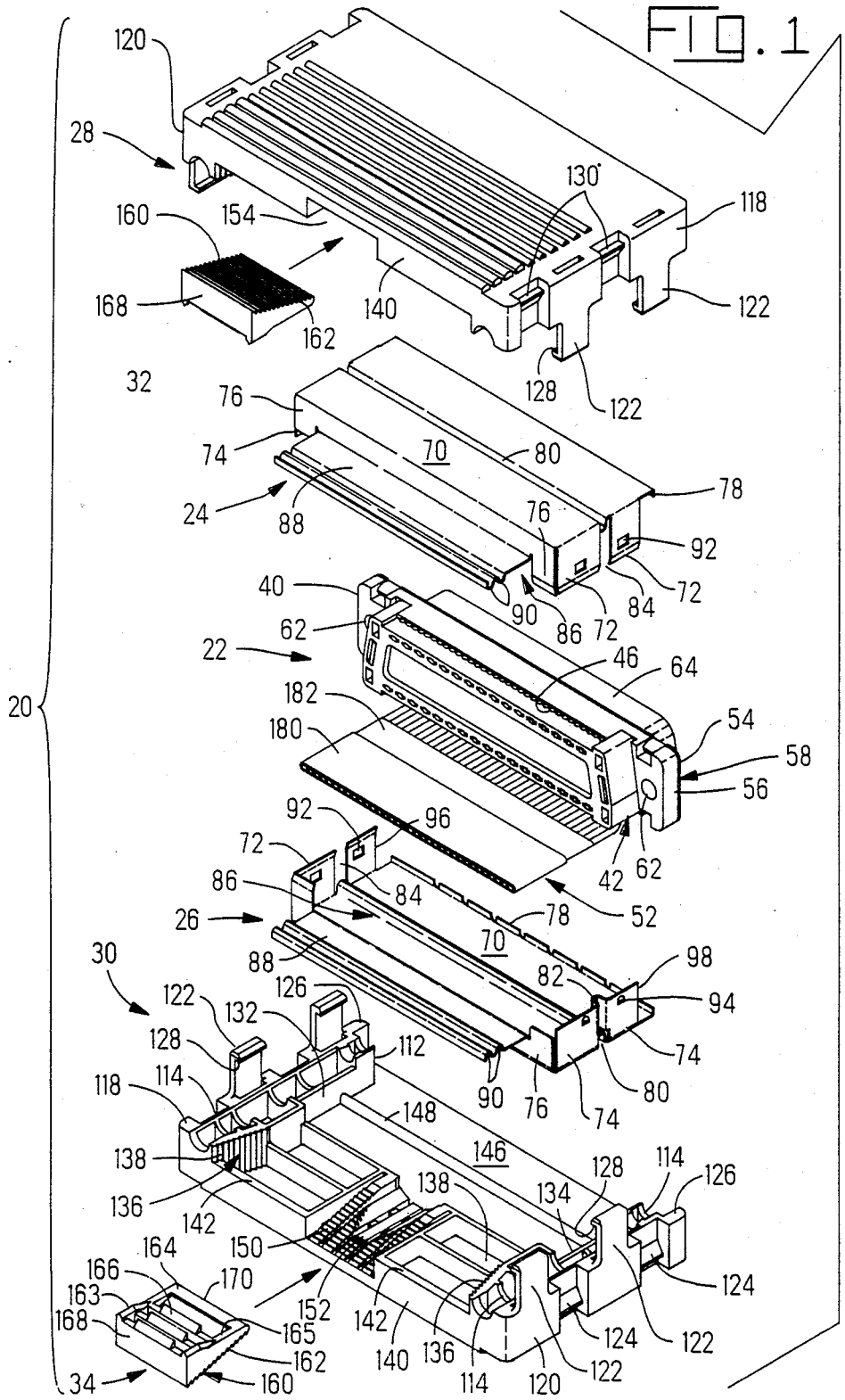
FIG. 1 is an exploded isometric view of a shielded connector assembly in accordance with the present invention.

A shielded connector assembly 20 in accordance with the present invention is shown in FIG. 1. Connector assembly 20 in the preferred embodiment includes connector 22, upper and lower electrically conductive shields 24,26, upper and lower cover members 28,30 and upper and lower strain relief and electrical continuity insert means 32,34.

Connector 22 has insulative housing 40 and terminating cover 42 molded of thermoplastic. Housing 40 has a mating face 44, a rear cable receiving face 46 and a plurality of contact receiving passages 48 extending therebetween having contacts 50 terminable to multiconductor cable 52 secured therein. Front shell 54 is secured to housing 40, has a periphery 56, and apertures 58 proximate ends thereof for securing a complementary connector thereto. Housing 40 may have a coextensive flange 60 with corresponding apertures 62. Shroud 64 is integral with and extends forwardly from front shell 54 to enclose the forward portion of housing 40. Connector 22 may be any known cable terminable connector such as the connector disclosed in U.S. Pat. No. 4,241,970, the disclosure of which is hereby incorporated by reference.

Electrically conductive shields 24 and 26 in the preferred embodiment are hermaphroditic; the invention however is not limited thereto. Shields 24 and 26 provide a shield assembly which when secured together forms a cavity for receiving connector 22. Each shield 24, 26 is stamped and formed metal member having a generally wall 70 with depending side walls 72,74 and rear wall 76. Flanges 78 are formed in the direction of side walls 72 and 74 along the forward edge of wall 70. An inwardly extending rib 80 extends transversely across wall 70 from between side walls 72 to between side walls 74. A corresponding inwardly extending rib 82 is formed between end walls 74 and clears rib 80. Ribs 80 and 82 impart strength respectively to walls 70 and 74. A gap 84 results between side walls 72. A portion of rear wall 76 is folded over to provide cable exit 86 and extension 88 having ribs 90 for engaging shielding on cable 52. Rib 90 provides strength to extension 88, is resilient and concentrates the force applied by insert means 32,34 along the apex thereof. Side walls 72 and 74 have complementary latching means for securing shields 24 and 26 together. In the preferred embodiment, side walls 72 have an aperture or recess 92 therein positioned to receive a protrusion 94 on side wall 74 of the other shield when the shields 24 and 26 are positioned about connector 22.

As shields 24 and 26 are moved toward each other to secure connector 22 therebetween, rib 80 of each shield is received in gap 84 of the other shield. Rib 82 provides shielding through the region that would otherwise be a gap and provides an electrical path between the two portions of end walls 74. Simultaneously, flanges 78 extend over the periphery 56 of connector 22 and forward edge 96 of an end wall 72. Forward edge 98 of an end wall 74 engages the rear of connector 22 to secure connector 22 in the latched shields as shown in FIG. 2.

Figures 2, 3, 4:
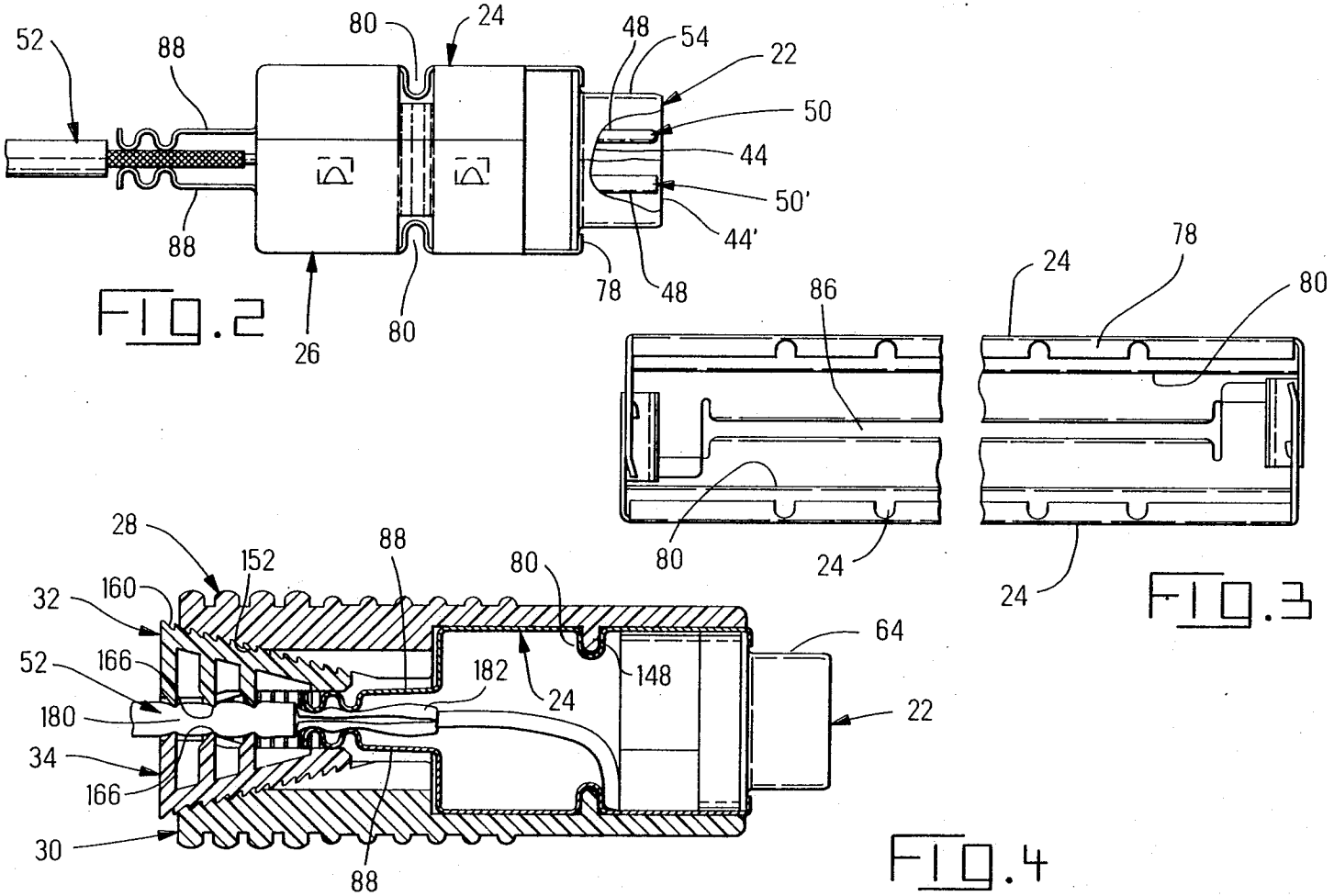
FIG. 2 is a side view showing the electrically conductive shields releasably secured together enclosing a connector.
FIG. 3 is a front view of the electrically conductive shields releasably secured together.
FIG. 4 is a side view, partly in section, of the shielded connector assembly of FIG. 1 providing strain relief and electrical continuity to cable shielding a flat cable terminated to the connector in the assembly.

As best seen in FIG. 3, side walls 72 of one shield are received within side walls 74 of the other shield, however, the invention is not limited thereto. Shields 24,26 when secured to each other provide shielding for connector 22 and the conductors of cable 52 terminated thereto.

Cover members 28,30 in the preferred embodiment are hermaphroditic. The invention, however, is not limited thereto. Cover members 28,30 provide a cover assembly which when secured together form a cavity for receiving the shield assembly. Cover members 28,30 have a flange 110 that collectively circumscribe the periphery 56 of connector 22 and flanges 78 of shields 24,26 when received in the cover assembly. Shoulder 112 and cover members 28,30 collectively engages and positions the connector flange. Channels 114 collectively comprise jack screw (not shown) receiving passages 116 that align with apertures 62. Jack screws received in passages 116 and passing through aperture 62 secure a complimentary connector (not shown) to connector 22.

Cover members 28,30 have latch means along side walls 118,120 for releasably securing the cover members together. As cover members 28,30 are moved toward each other resilient latches 122 on one cover member ride over ramped lugs 124 on the other cover member until surfaces 126 abut. The cover members are secured to each other when latches 122 resile such that shoulder 128 on a latch 122 engages a respective shoulder 130 on lug 124.

Inner side walls 132,134 have tapered surfaces 136 having serrations 138 thereon. Tapered surfaces 136 on inner side walls 132,134 taper inwardly toward each other, when cover members 28,30 are positioned to be latchingly secured, in a direction from rear surface 140 toward flange 110. Surfaces 142 are recessed from surface 126 defining cable exit 144 through which a flat shielded cable 52 can pass between surfaces 142 of cover members 28,30 when surfaces 126 thereof are in engagement.

Inner walls 146 have a transverse rib 148 extending thereacross that protrudes into the cavity. Rib 148 is substantially perpendicular to the axis of the cable received in assembly 20. Ribs 148 are positioned on inner walls 146 and sized to be received in rib 80 of a respective shield 24,26 as cover members 28,30 are moved toward each other to be releasably secured together as described above. Ribs 80 and !48 cooperate to provide means to secure the shielded assembly in the cover assembly in a predetermined position, thereby securing the cover assembly on the shield assembly which in turn holds the connector.

Inner walls 146 proximate rear surface 140 may have a tapered surface 150 having serrations 152 thereon in addition to or instead of tapered surface 136. Tapered surfaces !50 taper inwardly toward each other, when cover members 28,30 are positioned to be latchingly secured together, in a direction from rear surface 140 toward flange 110. Tapered surface 150 defines offset 154 in rear surface 140 to provide ramped tapered surface 150 and receive an insert means 32 or 34.

Upper and lower strain relief and electrical continuity insert means 32 and 34 are identical in the preferred embodiment, however the invention is not limited thereto. Insert means 32,34 are wedge shaped being substantially triangular or trapezoidal in cross section normal to the cable they engage, have a tapered surface engaging side 160 having serrations 162 thereon, a cable engaging side 164 having protrusions 166 on a trailing portion 163. Insert means 32,34 are tapered from a thicker end 168 on which an insertion force may be applied to a thinner end 170 which is the leading end received in offset 154. The slope of tapered surface 150 is substantially complementary to the slope of surface 160 such that an insert means 32,34 being inserted into offset 154 rides up surface 148 with surface 164 remaining substantially parallel to surface 142. Serrations 162 and 152 are complementary, and function together in a ratcheting action to prevent insert means 32,34 from backing out subsequent to insertion. Insert means 32,34 are plastic members the serrations on which will yield under plastic deformation a small amount during insertion of insert means 32,34.

Assembly of the strain relief and shielded backshell system is achieved by trimming the cable insulative jacket 180 back from the end of cable 152 an appropriate length such that the cable jacket terminates in the region of the cable exit of covers 28,30 such that jacket 180 is engageable by insert means 32,34 as shown in FIG. 4. The cable shield 182 is slit on both sides of the cable approximately half of the distance the jacket was trimmed. The cable shield is folded back on itself if the shield has an exterior insulative layer; the fold can be omitted if there is no insulative layer on the shield. The shield is positioned such that when extension 88 is pressed by insert means 32,34 the extension engages the shield, as shown in FIG. 4. The connector 22 is terminated to the ribbon cable. Shield members 24,26 are pressed together securing them around the terminated connector, positioning and securing the terminated connector therein, and simultaneously positioning cable shield 182 between extensions 88 on shields 24,26. The shield assembly is positioned in one of the covers with rib 148 of the cover received in rib 80 of the shield. The other cover is pressed into position with rib 148 of the cover being received in rib 80 of a respective shield, until latches 122 secure the covers 28,30 together, positioning and securing the shield assembly therein.

Insert means 32,34 are oriented with protrusions toward cable 52 and tapered end 170 inserted into offsets 154 then, preferably simultaneously, pressed into offsets 154. As insert means 32,34 are inserted surface 160 slides along surface 150 and serrations thereon ratchet up ramped surface 152, the protrusions 166 on trailing portion 163 of surface 164 engage jacket 180 and may push cable 52 into covers 28,30 slightly. The leading portion 65 of surface 164 engages extension 88 and presses extension 88 into engagement with shield 182, assuring electrical continuity between extension 88 and shield 182. Cable 52 and shield 182 are compressed between an insert means and structure on the opposite side of the cable and shield, which may be a planar surface such as surface 142, to simultaneously provide strain relief to cable 52 and electrical continuity between shield 182 and a conductive shield 24 or 26. In the preferred embodiment, the invention provides an insert means on each of the two flat sides of cable 52 such that the shield and cable are compressed between the two insert means. With an extension on each flat side of cable 52 pressing against shield 182 substantially along the length of ribs 90, electrical continuity between extension 88 and shield 182 is achieved around substantially the entire periphery of cable 52. Ribs 90 provide resilient engagement between shields 24,26 and shield 182. As best seen in FIG. 4, protrusions 166 of insert means 32,34 compress jacket 180 of cable 52 therebetween, thereby providing strain relief to cable 52. Simultaneously, the leading end 165 of cable engaging side 164 engages extension 88 resiliently pressing a rib 90 on extension 88 into engagement with shield 182, thereby assuring electrical continuity by mechanical engagement between extension 88 and shield 182.

Figure 5:
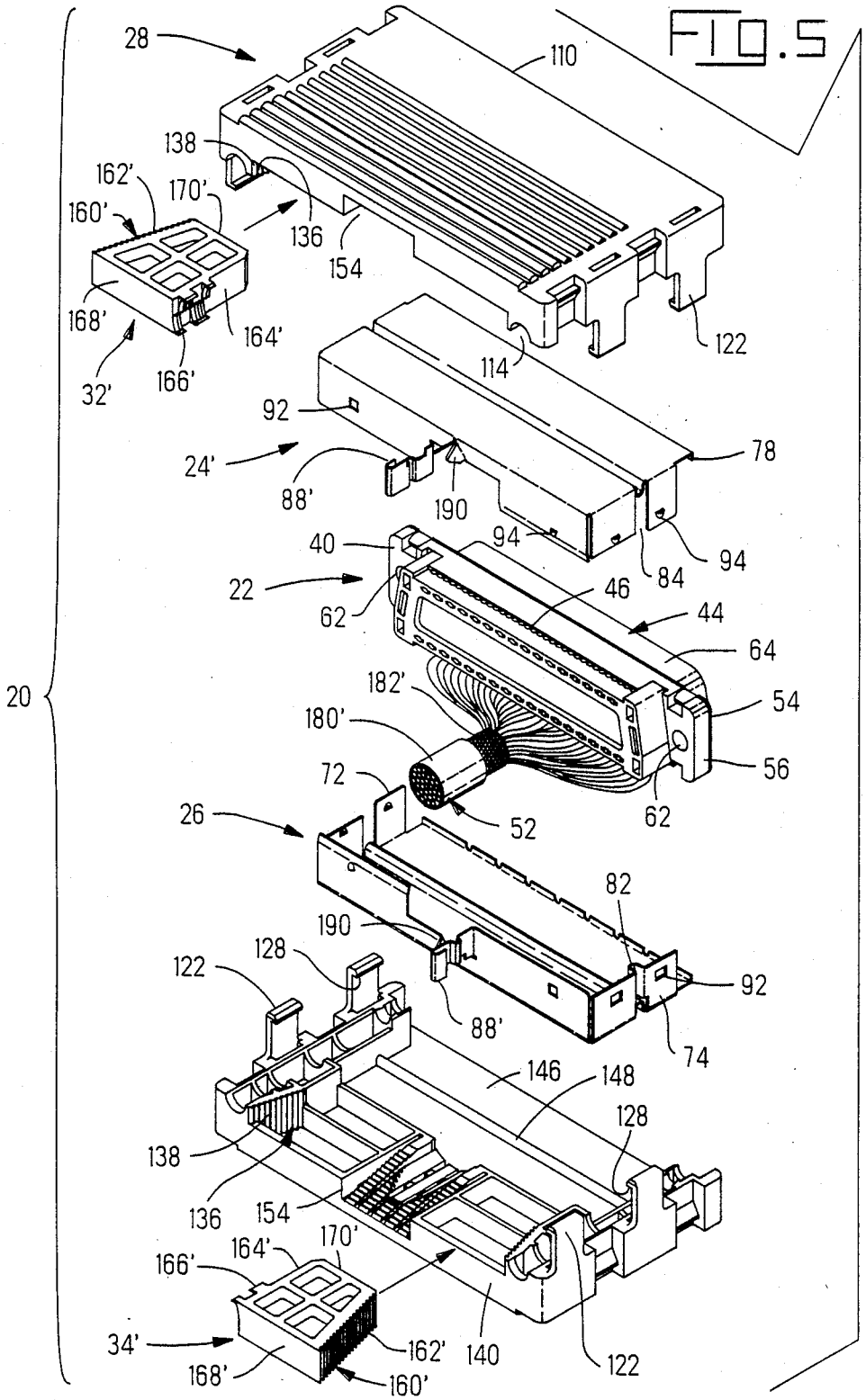
FIG. 5 is an alternate embodiment shielded connector assembly which provides for terminating round cable to the connector.

FIG. 5 shows an alternate embodiment shield assembly in that extension 88, and flange 190 are adapted for use with a round cable as are insert means 32' and 34'.

Figure 6:
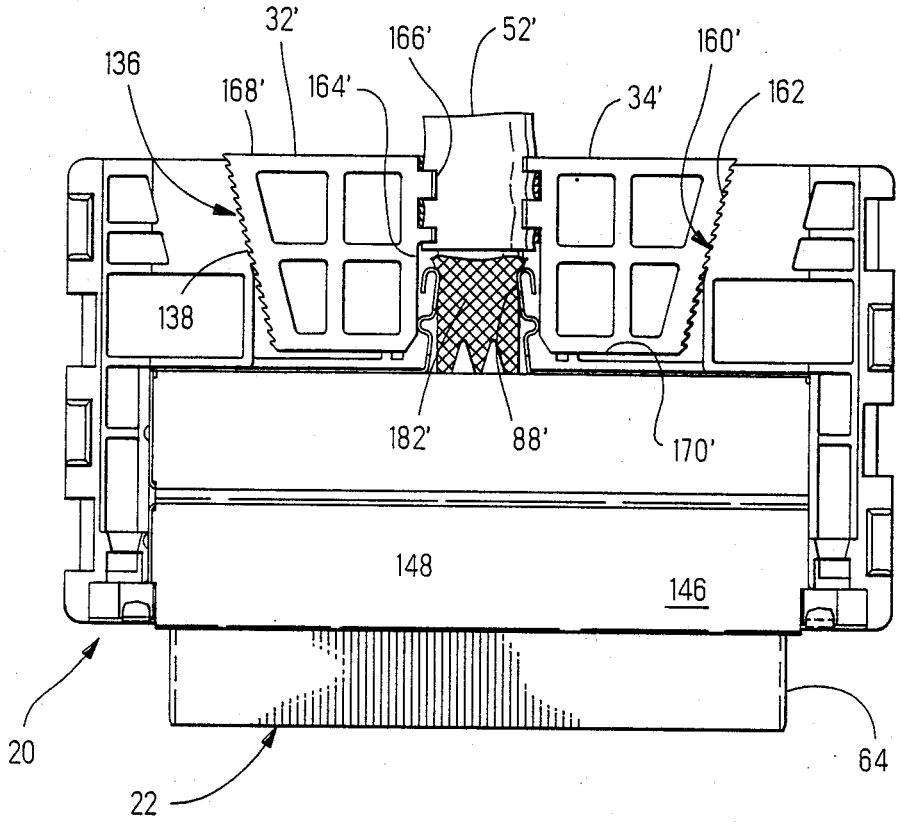
FIG. 6 is a top view, partly in section, of the alternate embodiment shielded electrical connector assembly of FIG. 4 providing strain relief and electrical continuity to the cable shielding of a round cable terminated to the connector in the assembly.

FIG. 6 shows insert means 32' and 34' positioned in the cover assembly with surface 160' engaging tapered surface 134 and serrations 136 engaging serrations 162', Concave protrusions 166' on insert means 32' and 34' compress round cable 52' around substantially the entire circumference to provide strain relief. The forward portion 165' of surface 164' presses extension 88' into engagement with shield 182'.

Figure 7:
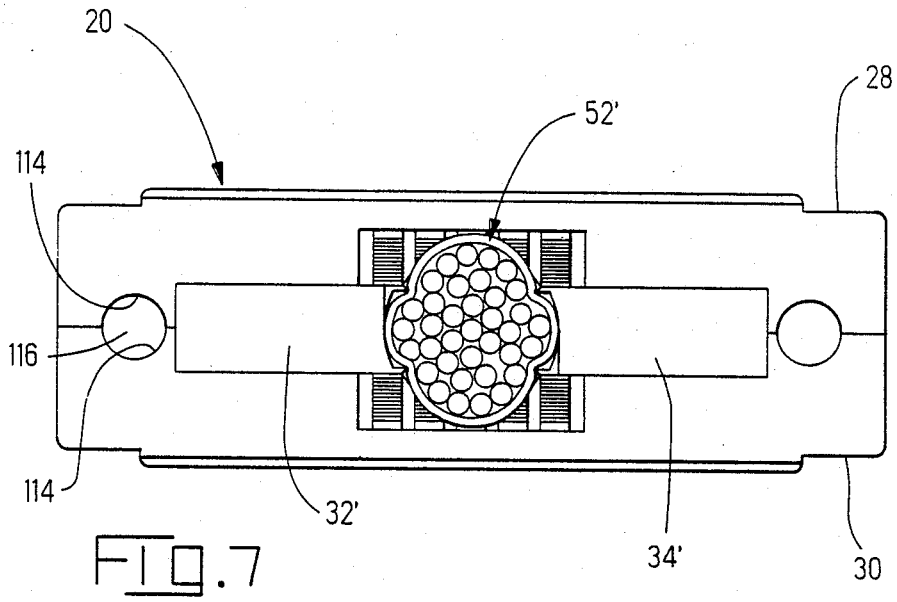
FIG. 7 is a rear view of the alternate embodiment shielded electrical connector assembly.

FIG. 7 shows how cable 52 is compressed by insert means 32' and 34' with the result that cable 52 and shield 182' deform to extrude into engagement with flanges 190 to provide engagement between shield 182' and shields 24,26 approaching 360° around cable 52'.

A strain relief and shield continuity system has been described in which the normal force to achieve the strain relief and shield continuity is provided in the same direction. The assembly may be taken apart by releasing the latches on covers 28 and 30, removing insert means 32,34 by sliding them along the serrations, normal to the direction of their insertion, then releasing the latches on shield members 24,26 to remove connector 22. While the strain relief and shield continuity system has been described as having separate electrically conductive shields and cover members, the function of an electrically conductive shield and a cover member may be combined into a single structure.

I claim:

1. A shielding assembly for providing strain relief and electrical continuity to a shielded cable received therein, the shielded cable having a portion of the shield exposed, said shielding assembly comprising:

shield means defining a cavity for receiving a portion of the shielded cable, said shield means having a cable exit and an extension proximate the cable exit;

insert means having first and second surfaces, said insert means adapted to be received in the shielding assembly, the first surface adapted to slide along a ramped surface of the shielding assembly, the second surface adapted to engage the cable and extension as the insert means is slid along the ramped surface, thus compressing the cable and pressing the extension into engagement with the cable shield, whereby strain relief for the cable and electrical continuity between the cable shield and the shield means are simultaneously achieved as the second surface of the insert means presses the cable and extension in the same direction.

2. A shielding assembly as recited in claim 1, wherein the cable exit is adapted to receive a flat shielded cable.

3. A shielding assembly as recited in claim 1, wherein the cable exit is adapted to receive a round shielded cable.

4. A shielding assembly as recited in claim 1, wherein the shielding means comprise a pair of shield members.

5. A shielding assembly as recited in claim 4, wherein the shield members are hermaphroditic.

6. A shielding assembly as recited in claim 1, further comprising cover means defining a cavity for receiving the shielding means.

7. A shielding assembly as recited in claim 6, wherein the cover means comprises a pair of hermaphroditic covers.

8. A shielding assembly as recited in claim 6, wherein the shielding means further comprises a groove, the cover means further comprising a complementary rib adapted to be received in the groove, whereby when the cover means is disposed about the shielding means, the rib is received in the groove to position the cover means on the shielding means.

9. A shielding assembly for providing strain relief and electrical continuity to a shielded cable received therein, the shielded cable having a portion of the shield exposed, said shielding assembly comprising:

shield means defining a cavity for receiving a portion of the shielded cable, said shield means having a cable exit and an engagement means proximate the cable exit;

cover means defining a cavity for receiving the shield means, said cover means having a cable exit, said cover means having a ramped surface proximate said cable exit;

insert means having first and second surfaces, said insert means adapted to be received in the cover means, the first surface adapted to slide along the ramped surface of the cover means, the second surface adapted to engage the cable and engagement means as the insert means is slid along the ramped surface, thus compressing the cable and pressing the engagement means into engagement with the cable shield, whereby strain relief for the cable and electrical continuity between the cable shield and the shield means are simultaneously achieved as the second surface of the insert means presses the cable and the extension means in the same direction.

10. A shielding assembly as recited in claim 9, wherein the shielding means comprises a pair of shield members.

11. A shielding assembly as recited in claim 10, wherein the shield members are hermaphroditic.

12. A shielding assembly as recited in claim 9, wherein the cover means comprises a pair of cover members.

13. A shielding assembly for providing strain relief and electrical continuity to a shielded cable received therein, the shielded cable having a portion of the shield exposed, said shielding assembly comprising:

shield means defining a cavity for receiving a portion of the shielded cable, said shield means having a cable exit and an engagement means proximate the cable exit;

first and second cover members, said first and second cover members adapted to be releasably secured together, said cover members defining when secured together a cavity for receiving the shield means and a cable exit, each of said cover means having a ramped surface proximate the cable exit, the ramped surfaces being on opposed sides of the cable exit with the cover members latched together;

first and second insert means having first and second surfaces, said insert means adapted to be received in the cover members, the first surface of each insert means adapted to slide along a respective ramped surface of a said cover member, the second surface of each insert means adapted to engage opposite sides of the cable and engage a respective said engagement means as the insert means are slid along respective ramped surfaces, thus compressing the cable and engagement means between the insert means and pressing the engagement means into engagement with the cable shield, whereby strain relief for the cable and electrical continuity between the cable shield and the shield means are simultaneously achieved by the insert means as the second surfaces of each insert means compress the cable and presses the engagement means in the same direction.

14. A shielding assembly as recited in claim 13 wherein the cover members each have a second ramped surface proximate the cable exit, said second ramped surfaces oriented substantially normal to the ramped surfaces.

* * * * *